United States Patent [19]

Morris et al.

[11] Patent Number: 4,643,211

[45] Date of Patent: Feb. 17, 1987

[54] COLLAPSIBLE WALKING FRAME HAVING PIVOTAL SEAT

[75] Inventors: Thomas A. Morris; Leslie D. Norman, both of Basildon, England

[73] Assignee: Uniscan Limited, Essex, England

[21] Appl. No.: 667,881

[22] Filed: Nov. 2, 1984

[30] Foreign Application Priority Data

Nov. 8, 1983 [GB] United Kingdom ..... 8329723

[51] Int. Cl.[4] ..... A61H 3/04

[52] U.S. Cl. ..... 135/67; 297/6

[58] Field of Search ..... 135/67; 297/5, 6, DIG. 6, 297/59, 60; D3/5, 6, 7, 8, 9; 182/124, 125, 126

[56] References Cited

U.S. PATENT DOCUMENTS

| | | | |
|---|---|---|---|
| Re. 24,817 | 4/1960 | Hogan | 297/6 |
| 2,656,874 | 10/1953 | Robb | 135/67 |
| 2,798,533 | 7/1957 | Frank | 135/67 X |
| 2,866,495 | 12/1958 | Diehl et al. | 155/22 |
| 3,354,893 | 11/1967 | Schmerl | 135/67 |
| 3,840,034 | 10/1974 | Smith | 135/67 |
| 4,162,101 | 7/1979 | McCague, Sr. et al. | 135/67 X |
| 4,290,502 | 9/1981 | Anderson | 182/125 X |
| 4,314,576 | 2/1982 | McGee | 297/6 X |
| 4,320,817 | 3/1982 | Knoke et al. | 182/126 |

FOREIGN PATENT DOCUMENTS

| | | | |
|---|---|---|---|
| 0007708 | 6/1979 | European Pat. Off. . | |
| 1465277 | 2/1977 | United Kingdom | 135/67 |
| 1498895 | 1/1978 | United Kingdom | 135/67 |
| 2076666B | 5/1981 | United Kingdom . | |
| 2097684A | 4/1982 | United Kingdom . | |
| 2074033 | 1/1984 | United Kingdom | 135/67 |

*Primary Examiner*—Robert A. Hafer
*Assistant Examiner*—Arnold W. Kramer
*Attorney, Agent, or Firm*—Leydig, Voit & Mayer, Ltd.

[57] ABSTRACT

The collapsible walking frame for use by an invalid comprises a pair of interconnected spaced side frames (10, 12) each including a front member (14) having a handgrip (18) and a rear member (24) pivotally connected to the front member (14). A seat (28) pivotally connected between the front members (14) is movable from an inoperative vertical position to an operative horizontal position. The seat (28) is horizontally supported in the operative position on rear brace (26) and held in the vertical position by being fastened to front brace (22). The front and rear members of the side frames are stably supported in the operative position of the frame by pivotal locking side braces (27) which permit pivotal folding of the frame to the inoperative storage position.

1 Claim, 3 Drawing Figures

COLLAPSIBLE WALKING FRAME HAVING PIVOTAL SEAT

The present invention relates to a collapsible walking frame which can be used by an invalid as a walking aid.

The object of the present invention is to provide a collapsible walking frame which is light in weight, compact when collapsed and can be used as a seat when required.

The present invention consists of a collapsible walking frame comprising a pair of interconnected, spaced side frames each including a front member and a rear member pivotally connected thereto, and a seat pivotally mounted between said front members, and movable from an inoperative vertical position to an operative horizontal position.

Figure 1:
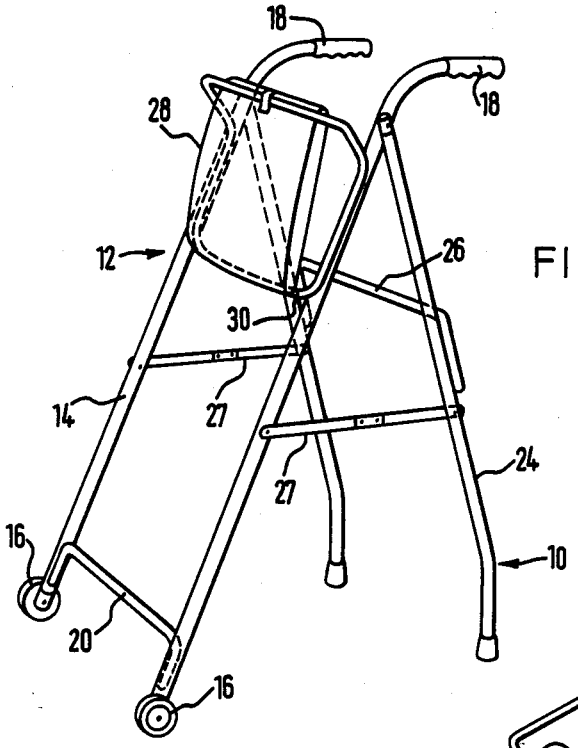
FIG. 1 is a perspective view of a walking frame according to the present invention showing the seat in the inoperative position.

In carrying the invention into effect according to one convenient mode, by way of example, a walking frame comprises a pair of upright and laterally spaced side frames 10, 12, each of which is formed of tubular metal and is of 'A'-shaped configuration.

Each side frame includes a front frame member 14 having a wheel 16 rotatably mounted on it's lower end with it's upper end bent through approximately a right-angle to provide a horizontal disposed hand grip portion 18. The front members 14 are rigidly interconnected by a lower inverted 'U'-shaped brace member 20 and an upper inverted 'U'-shaped brace member 22.

Each side frame also includes a rear frame member 24 pivotally connected adjacent to it's upper end to the associated front member 14 and the rear members 24 are rigidly interconnected by an inverted 'U'-shaped brace member 26. Each rear member 24 is connected to it's associated front member 14 by a pivotal locking side-brace 27, the pivotal movement of which permits movement of the front and rear members 14, 24 respectively, towards each other into a collapsed condition as shown in FIG. 3.

A padded seat 28 is pivotally mounted along one edge to the horizontal portion of a 'U'-shaped brace member 30 which also interconnects the front frame members 14. When in the operative or seating position as shown in FIG. 2, the seat 28 is pivoted to a substantially horizontal position and its free end portion rests on the brace member 26, the latter being at substantially the same elevation as the brace member 30 as is apparent from FIGS. 1 and 2. When moved to the inoperative or vertical position shown in FIG. 1, the seat is retained against the brace member 22 by Velcro (RTM) material.

If desired, the underside of the seat 28 may be formed to provide a pocket closed by a sliding clasp fastener.

Figure 2:
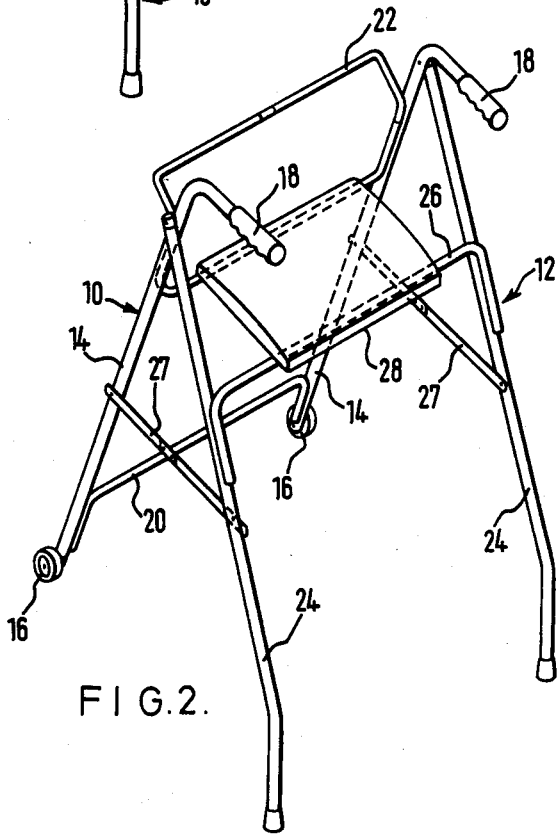
FIG. 2 is a view similar to FIG. 1, but showing the seat in the operative position.
Figure 3:
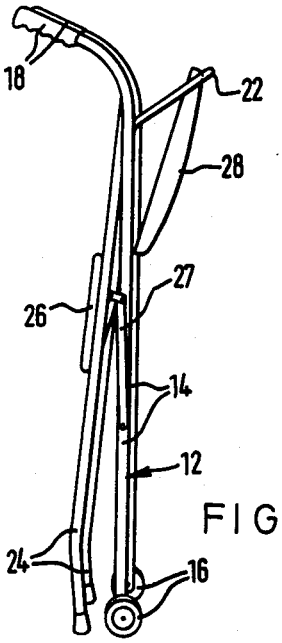
FIG. 3 is a side view of the walking frame according to the present invention shown in it's collapsed condition.

In use, the frame is first pivoted from it's collapsed condition shown in FIG. 3 to it's operative condition shown in FIG. 1. The user then positions himself between the side frames 10, 12 and grips the handles 18. The frame is then moved forward the required distance on the wheels 16 and the user follows supported by the now stationary frame. The frame cannot slip or slide, as any weight on the rear members 24 prevents any further movement. Preferably, the rear members 24 are provided with rubber stopguards.

We claim:

1. A collapsible walking frame comprising a pair of upright and laterally spaced side frames each having a front frame member and a rear frame member, wheels rotatably mounted on the lower end portions of said front frame members, the extreme upper ends of said front frame members extending generally horizontally and rearwardly and defining gripping handles, a front brace member extending laterally between and interconnecting the front frame members of said side frames, a rear brace member extending laterally between and interconnecting the rear frame members of said side frames, the front and rear frame members of each side frame being pivotally connected to one another adjacent their upper ends to enable each side frame to be folded from an operative position to a collapsed position, the lower end portions of the frame members of each side frame being spread relatively far apart when the side frame is in its operative position and being located closely adjacent one another when the side frame is in its collapsed position, said brace members being located intermediate said side frame members and both being located at substantially the same elevation when said side frames are in said operative positions, a seat pivotally supported on said front brace member and freely swingable thereon between an upright stored position and a substantially horizontal active position when said side frames are in said operative positions, said rear brace member being located so as to support the underside of the free end portion of said seat when said side frames are in said operative positions and said seat is swung downwardly to said active position, a third brace member located above said front brace member and extending laterally between and interconnecting said front frame members, means for releasably securing the free edge portion of said seat to said third brace member when said seat is in said upright stored position and wherein the front and rear frame members of each respective side frame are interconnected by a respective pivotal locking side brace to stabilize the walking frame in the operative position and permit folding to the collapsed position.

* * * * *